US011530109B2

(12) United States Patent
Kaml et al.

(10) Patent No.: US 11,530,109 B2
(45) Date of Patent: Dec. 20, 2022

(54) COLLAPSIBLE, RE-USEABLE SPOOL

(71) Applicant: COMMSCOPE TECHNOLOGIES LLC, Hickory, NC (US)

(72) Inventors: Jonathan R. Kaml, Shakopee, MN (US); Michael J. Schomisch, Rosemount, MN (US); James J. Brandt, St. Louis Park, MN (US)

(73) Assignee: COMMSCOPE TECHNOLOGIES LLC, Hickory, NC (US)

( * ) Notice: Subject to any disclaimer, the term of this patent is extended or adjusted under 35 U.S.C. 154(b) by 39 days.

(21) Appl. No.: 17/043,391

(22) PCT Filed: Mar. 28, 2019

(86) PCT No.: PCT/US2019/024613
§ 371 (c)(1),
(2) Date: Sep. 29, 2020

(87) PCT Pub. No.: WO2019/191452
PCT Pub. Date: Oct. 3, 2019

(65) Prior Publication Data

US 2021/0107764 A1 Apr. 15, 2021

Related U.S. Application Data

(60) Provisional application No. 62/649,850, filed on Mar. 29, 2018.

(51) Int. Cl.
*B65H 75/22* (2006.01)
*B65H 75/14* (2006.01)

(52) U.S. Cl.
CPC ..... *B65H 75/22* (2013.01); *B65H 75/14* (2013.01); *B65H 2701/5136* (2013.01); *B65H 2701/534* (2013.01)

(58) Field of Classification Search
CPC .... B65H 75/14; B65H 75/22; B65H 75/2209; B65H 2701/534; B65H 2701/5136
See application file for complete search history.

(56) References Cited

U.S. PATENT DOCUMENTS 1,559,133 A 10/1925 Tunis et al.
1,674,709 A 6/1928 Thomas
(Continued)

FOREIGN PATENT DOCUMENTS

DE 19 26 414 A1 2/1971
GB 2 295 604 A 6/1996
(Continued)

OTHER PUBLICATIONS

International Search Report and Written Opinion of the International Searching Authority for International Patent Application No. PCT/US2019/024613 dated Jul. 12, 2019, 8 pages.
(Continued)

*Primary Examiner* — Sang K Kim
(74) *Attorney, Agent, or Firm* — Merchant & Gould P.C.

(57) ABSTRACT

A spool is transitionable between an operable (i.e., cable ready) state and a stowed (i.e., return ready) state. In the operable state, the spool is configured to receive and hold a coil of cable. In the stowed state, the spool has a reduced three-dimensional footprint compared to the operable state, thereby facilitating storage and return of the spools. The spool can be releasably locked in the operable state. When the lock is released, the spool can be freely transitioned between both states to facilitate reuse of the spool.

20 Claims, 20 Drawing Sheets

(56) References Cited

U.S. PATENT DOCUMENTS

| | | | | |
|---|---|---|---|---|
| 1,742,584 | A | 1/1930 | Daubmeyer et al. | |
| 1,831,848 | A | 11/1931 | Doney et al. | |
| 2,318,906 | A | 5/1943 | Troche et al. | |
| 2,465,631 | A | 3/1949 | Bruestle | |
| 2,990,135 | A | 6/1961 | Croteau et al. | |
| 3,432,113 | A | 3/1969 | Freedman | |
| 3,661,341 | A | 5/1972 | Eifrid | |
| 3,680,809 | A | 8/1972 | Blackmer et al. | |
| 3,791,606 | A | 2/1974 | Brown | |
| 4,009,842 | A | 3/1977 | Persha et al. | |
| 4,124,176 | A | 11/1978 | Carlson et al. | |
| 4,198,012 | A | 4/1980 | Esmonde et al. | |
| 4,456,020 | A | 6/1984 | Van Deursen | |
| 4,867,391 | A | 9/1989 | Resch | |
| 5,169,086 | A | 12/1992 | Vesely | |
| 5,242,129 | A | 9/1993 | Bailey et al. | |
| 5,467,939 | A | 11/1995 | Georges | |
| 5,547,147 | A * | 8/1996 | Georges | B65H 75/22 242/607.1 |
| 5,649,677 | A | 7/1997 | Culp | |
| 6,206,323 | B1 | 3/2001 | Byars | |
| 6,527,220 | B2 | 3/2003 | Weaver et al. | |
| 7,121,501 | B1 | 10/2006 | Lea | |
| 7,510,138 | B2 | 3/2009 | Chiorgno et al. | |
| 8,727,262 | B2 | 5/2014 | Underbrink et al. | |
| 9,862,566 | B2 | 1/2018 | Thakare et al. | |
| 10,294,066 | B1 | 5/2019 | Bigbee, Jr. et al. | |
| 2005/0051664 | A1 | 3/2005 | Maxwell et al. | |
| 2006/0060689 | A1 | 3/2006 | Fuller | |
| 2010/0025521 | A1 | 2/2010 | Snitselaar | |
| 2010/0051738 | A1 | 3/2010 | Harvey et al. | |

FOREIGN PATENT DOCUMENTS

| | | | |
|---|---|---|---|
| JP | 2002-104740 | A | 4/2002 |
| JP | 2004-043176 | A | 2/2004 |
| WO | 2012/056480 | A1 | 5/2012 |

OTHER PUBLICATIONS

Extended European Search Report for European Patent Application No. 19776957.3 dated Feb. 28, 2022, 11 pages.

* cited by examiner

COLLAPSIBLE, RE-USEABLE SPOOL

CROSS-REFERENCE TO RELATED APPLICATION

This application is a National Stage Application of PCT/US2019/024613, filed on Mar. 28, 2019, which claims the benefit of U.S. Patent Application Ser. No. 62/649,850, filed on Mar. 29, 2018, the disclosures of which are incorporated herein by reference in their entireties. To the extent appropriate, a claim of priority is made to each of the above disclosed applications.

BACKGROUND

Communications cable (e.g., fiber cable, coaxial cable, twisted pair cable, and power cable) is typically packaged on spools and shipped to installation sites. Larger spools tend to be made robust (e.g., out of metal or plastic) and hence are reusable. However, storage and shipping of these spools can be costly and/or wasteful of space. Smaller spools tend to be made of cardboard and are intended for single use. When the cable has been deployed from such spool, the spools tend to be discarded, thereby creating waste.

Improvements are required.

SUMMARY

Some aspects of the disclosure are directed to a spool that is transitionable between an operable (i.e., cable ready) state and a stowed (i.e., return ready) state. In the operable state, the spool is configured to receive and hold a coil of cable. In the stowed state, the spool has a reduced three-dimensional footprint compared to the operable state. The spool cannot hold cable when in the stowed state.

In use, cable is wound on an operable spool for storage and shipping and deployed from the cable-ready spool at an installation site. Once the cable is deployed, the spool can be transitioned to the stowed state. For example, the spool can be collapsed to have a smaller three-dimensional footprint. One or more stowed spools can be packaged together and shipped back to the cable supplier. The stowed spools also can be stored more easily (e.g., in a smaller area) compared to the operable spools. The spools can subsequently be transitioned back to a operable state by the cable supplier and reloaded with more cable.

In certain implementations, the spool is lockable in the operable state to inhibit transitioning states while cable is wound around the spool. In certain examples, the spool can be locked in the stowed state. In certain examples, the spool is locked by rotating a dial.

In certain implementations, the spool includes a drum extending between opposite axial end flanges. Transitioning the spool to the stowed state causes the axial end flanges to move closer together. In certain examples, only a height of the spool is reduced as the spool transition to the stowed state. In certain implementations, the drum of the spool deforms to expand radially outwardly to enable the axial end flanges of the spool to move closer together.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the embodiments disclosed herein are based.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Reference will now be made in detail to exemplary aspects of the present disclosure that are illustrated in the accompanying drawings. Wherever possible, the same reference numbers will be used throughout the drawings to refer to the same or like parts.

The present disclosure is directed to a cable spool that is transitionable between an operable state and a stowed state. In the operable state, the spool is configured to receive and hold a coil of cable. In the stowed state, the spool has a reduced three-dimensional footprint compared to the operable state. The spool cannot hold cable when in the stowed state.

Figure 1:
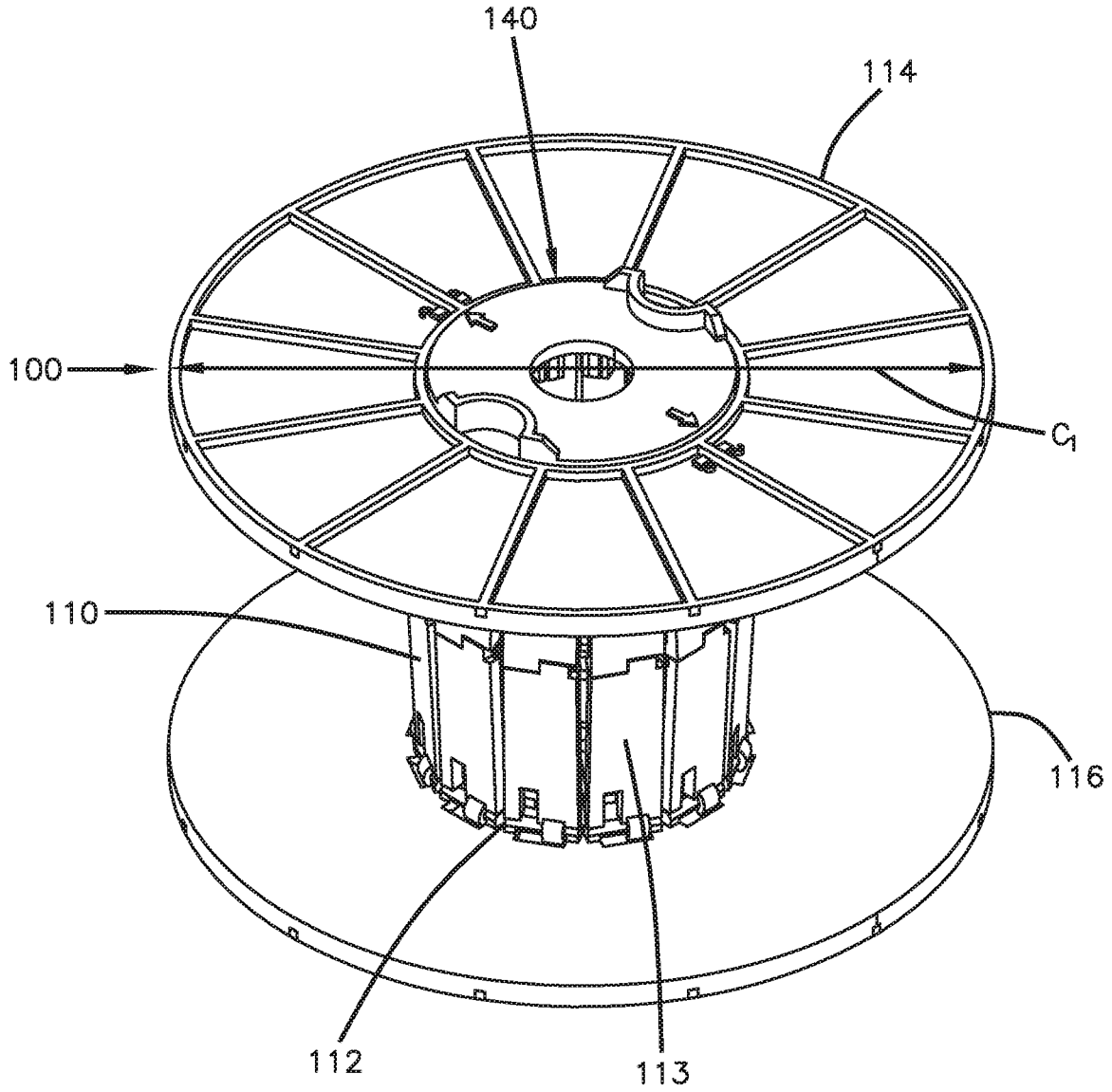
FIG. 1 is a top perspective view of an example spool configured in accordance with the principles of the present disclosure, the spool being disposed in an operable state.
Figure 2:
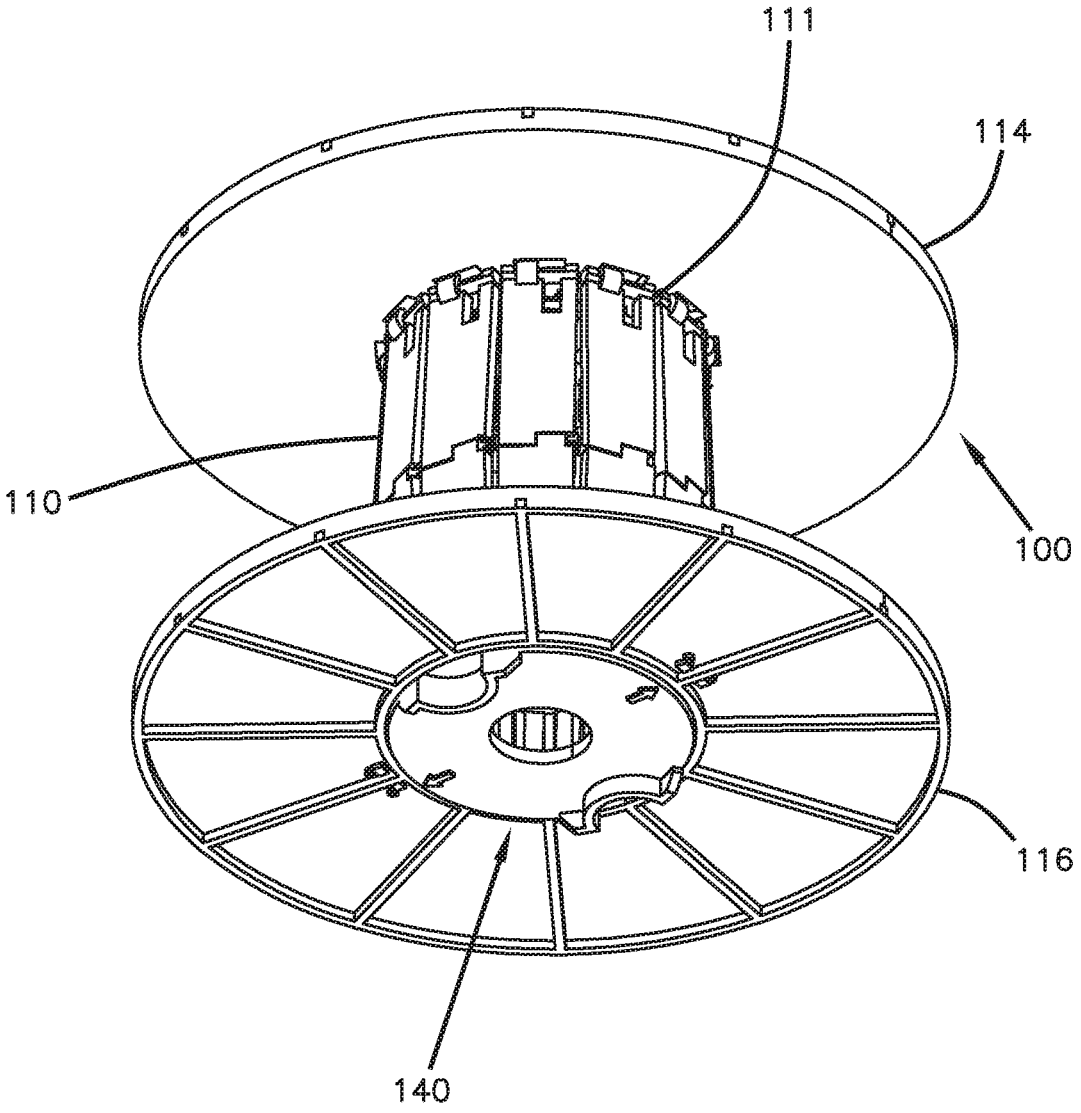
FIG. 2 is a bottom perspective view of the spool of FIG. 1.
Figure 3:
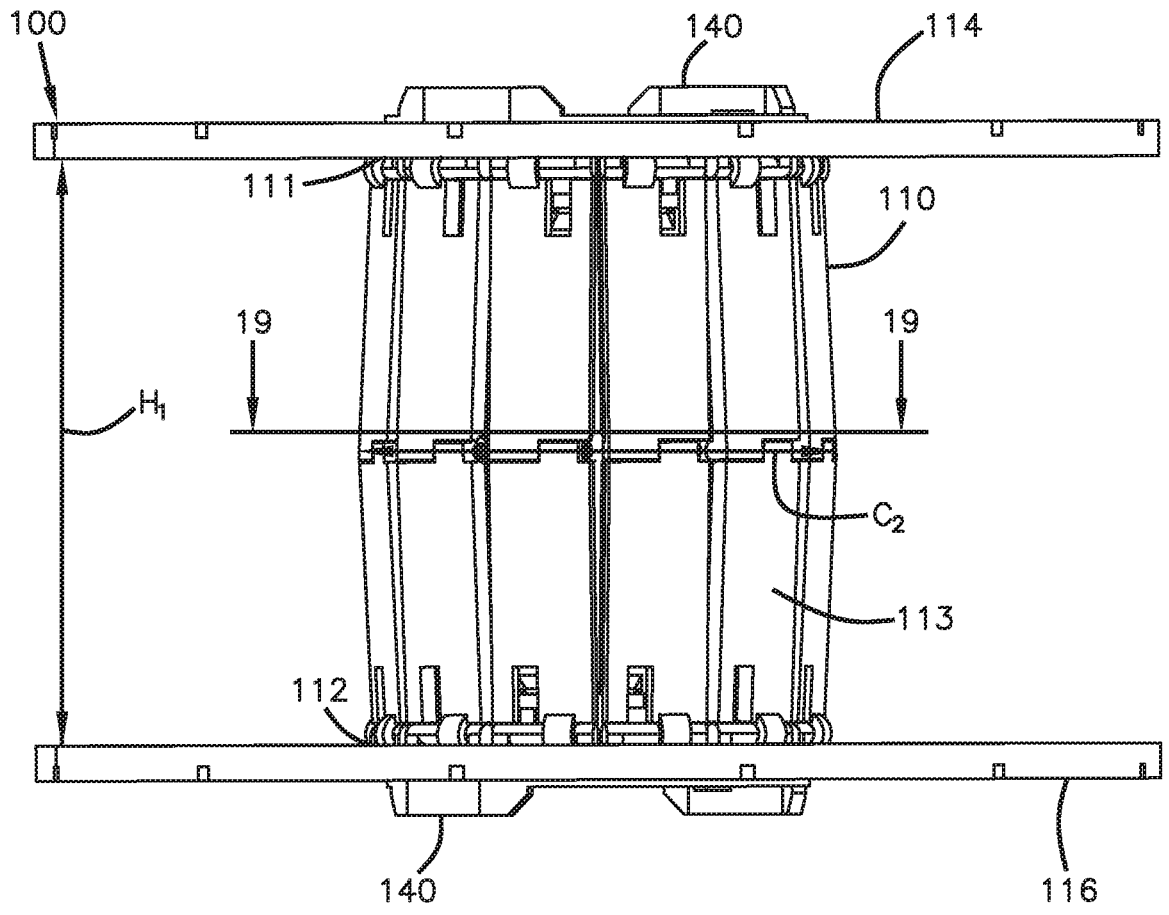
FIG. 3 is a side elevational view of the spool of FIG. 1.
Figure 4:
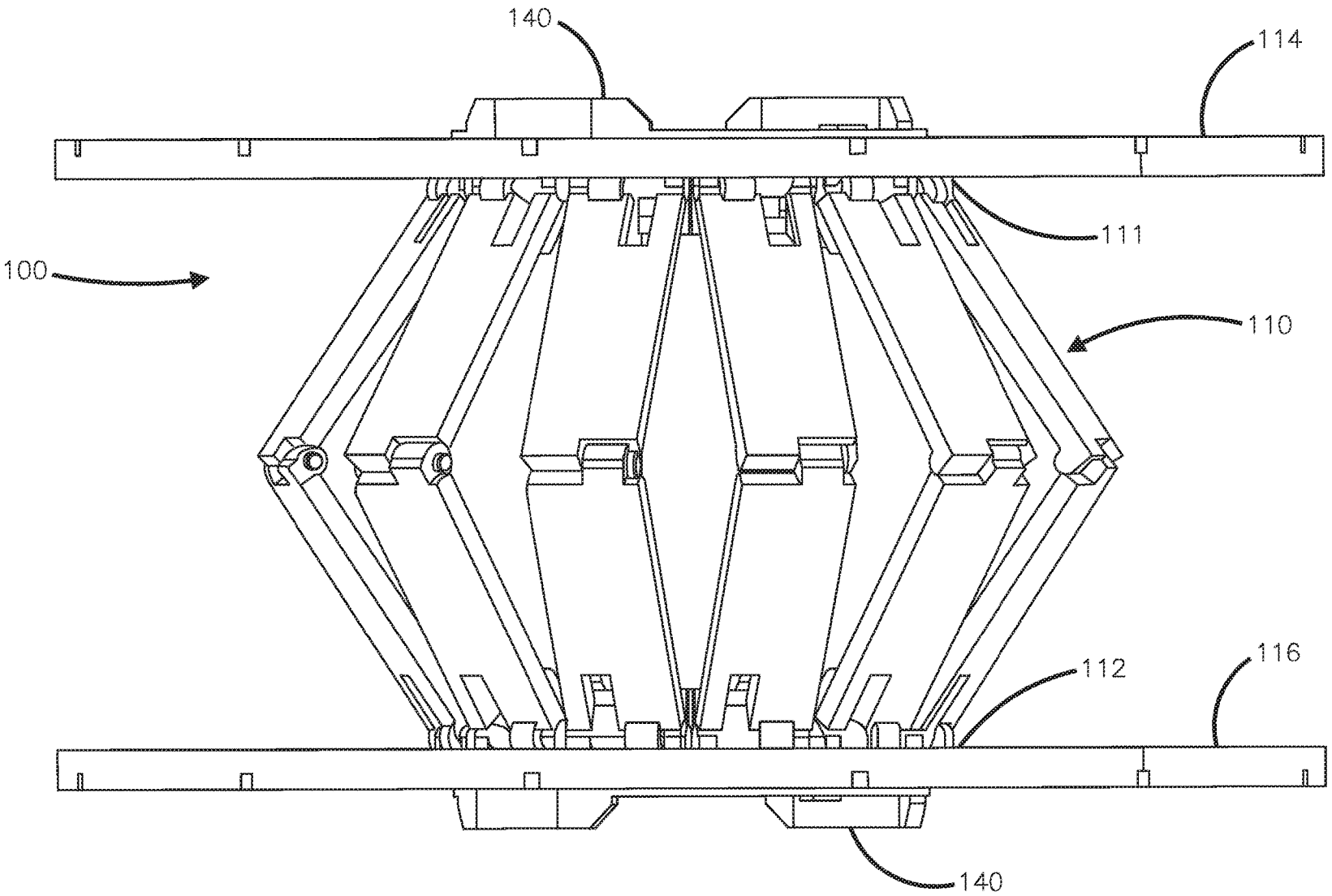
FIG. 4 is a side elevational view of the spool of FIG. 1 mid-transition between the operable state and a stowed state.
Figure 5:
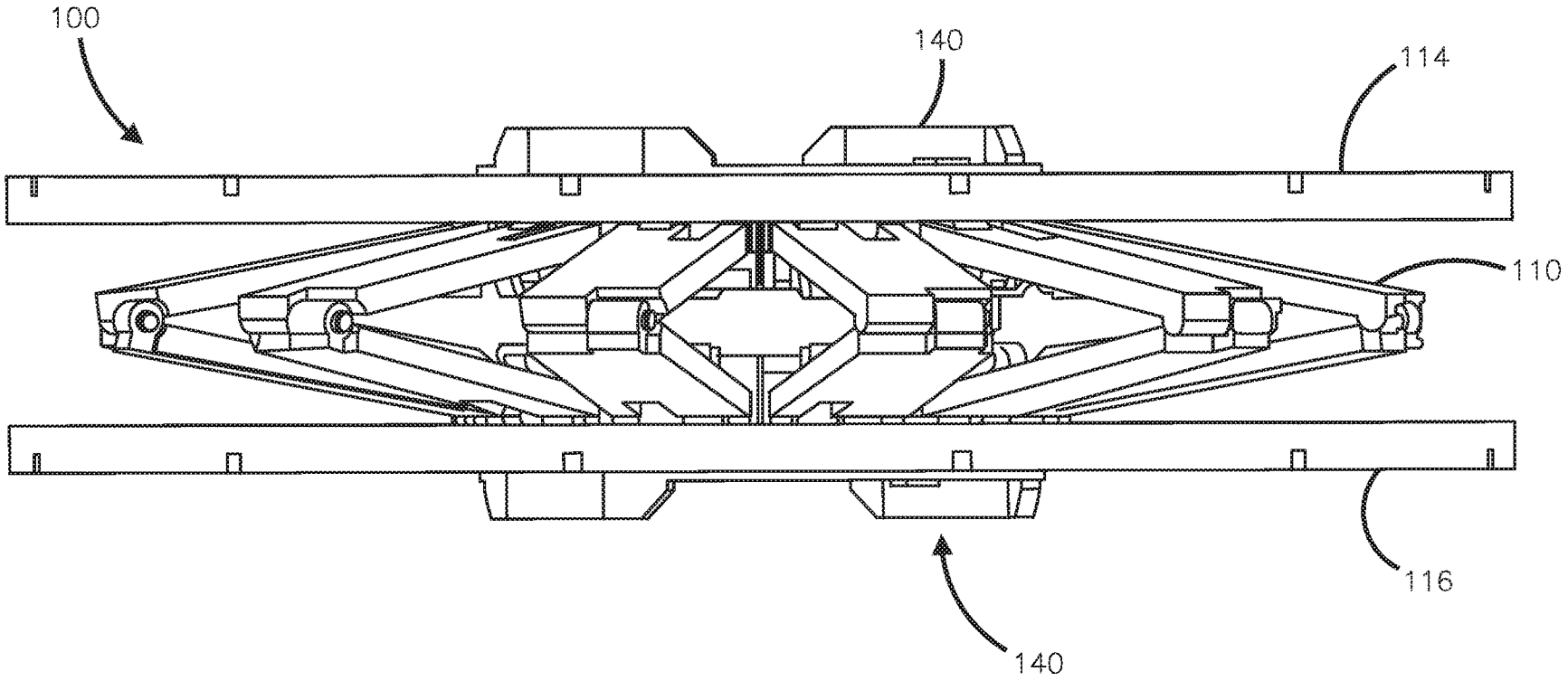
FIG. 5 is a side elevational view of the spool of FIG. 1 mid-transition between the operable state and a stowed state, but closer to the stowed state than FIG. 4.
Figure 6:
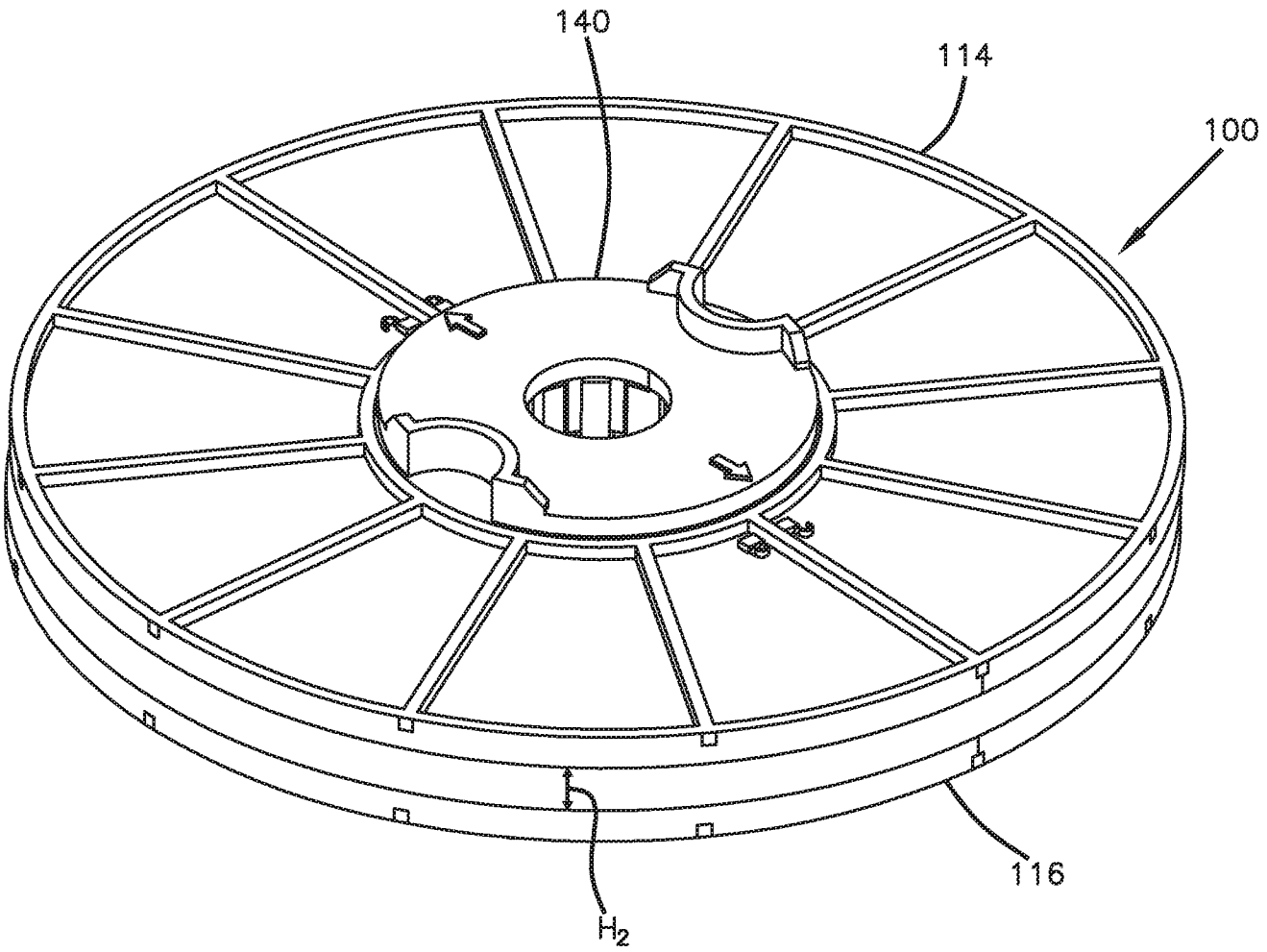
FIG. 6 is a top perspective view of the spool of FIG. 1 configured in the stowed state.

FIGS. 1 and 2 illustrate an example spool 100 configured in an operable state. The spool 100 includes a drum 110 extending along a height H between a first axial end 111 and a second axial end 112. A first radial flange 114 is disposed at the first axial end 111 and a second radial flange 116 is disposed at the second axial end 112. FIGS. 2-5 show the spool 100 transitioning between the operable state and the stowed state. FIG. 6 illustrates the spool 100 configured in the stowed state.

When in the operable state, the spool 100 has a first height H1. When in the stowed state, the spool 100 has a second height H2 that is smaller than the first height H1. The radial flanges 114, 116 of the spool 100 have a cross-dimension C1 (e.g., a diameter). In certain examples, the cross-dimension C1 does not change as the spool transitions between the operable and stowed states. In certain implementations, the drum 110 has a first cross-dimension C2 when the spool 100 is configured in the operable state and a second cross-dimension C3 when the spool 100 is configured in the stowed state with the second cross-dimension C3 being larger than the first cross-dimension C2.

When the spool 100 is in the operable state, the drum 110 defines a winding surface 113. In some implementations, the winding surface 113 is continuous. In other examples, the winding surface 113 is substantially continuous in that the winding surface 113 includes multiple gaps or separations along the surface 113 that are sufficiently small to not interfere with winding of a cable over the surface. For example, a substantially continuous winding surface 113 may be defined by a plurality of staves positioned adjacent each other to form a generally cylindrical shape.

In certain implementations, the spool 100 is hollow. In certain implementations, the spool 100 defines a through passage extending through a height of the spool 100 so that the spool 100 can be mounted to a pole to facilitate rotation of the spool 100 when paying off a cable from the spool 100.

In some implementations, the spool 100 includes a locking arrangement that releasably holds the spool 100 in the operable state. Accordingly, the spool 100 can be prevented from transitioning to the stowed state while cable is wound on the spool 100. In certain implementations, the locking arrangement also can releasably hold the spool 100 in the stowed state.

In certain implementations, the locking arrangement is operated by a user via an actuator 140. For example, the actuator 140 can be moved between a lock position and a release position. When the actuator 140 is disposed to the lock positon, the spool 100 is releasably locked against transitioning between states. When the actuator 140 is disposed in the release position, the spool 100 can transition between states.

In certain implementations, the actuator 140 rotates between the lock and release positions. For example, the actuator 140 may rotate about a rotation axis R (see FIG. 17) that extends along a height of the spool 100.

In some implementations, the locking arrangement includes a first actuator 140 disposed at the first radial flange 114 and a second actuator 140 disposed at the second radial flange 116. Both actuators 140 are movable between a lock position and a release position. In certain implementations, the spool 100 is transitionable between states when both actuators 140 are disposed in the release position. In certain implementations, the spool 100 is not transitionable between states when both actuators 140 are disposed in the lock position. In some implementations, the spool 100 is not transitionable between states when one of the actuators 140 is disposed in the lock position and the other actuator 140 is disposed in the release position. In other implementations, the spool 100 is partially transitionable between states when one of the actuators 140 is disposed in the lock position and the other actuator 140 is disposed in the release position.

Figure 7:
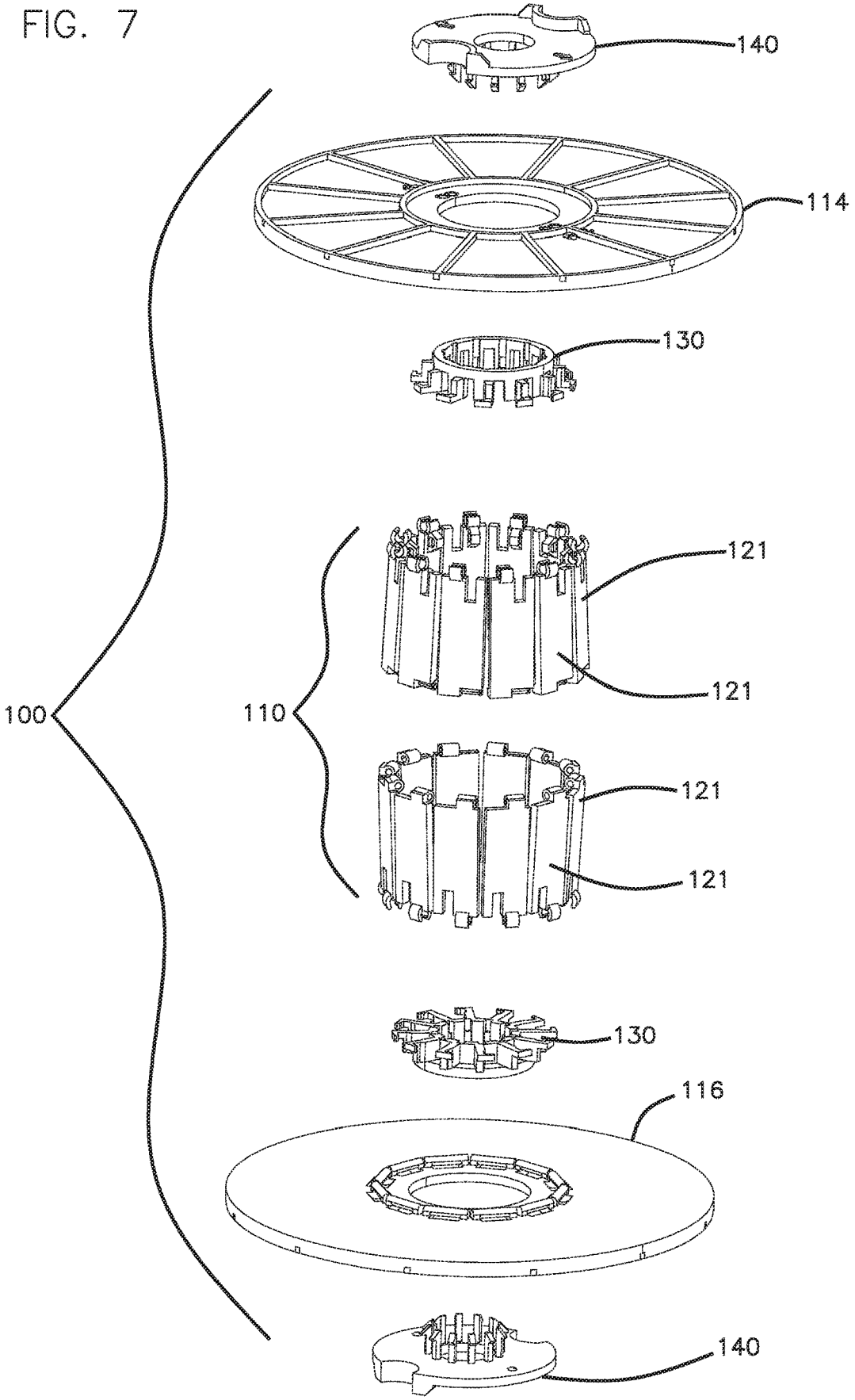
FIG. 7 is a perspective view of the spool of FIG. 1 with the components exploded away from each other for ease in viewing.

Referring to FIG. 7, an example spool 100 includes a drum 110 formed of a plurality of staves 120, a first radial flange 114, and a second radial flange 116. A first locking member 130 is disposed at the first radial flange 114. A first actuator 140 is operably coupled to the first locking member 130. In certain implementations, a second locking member 130 is disposed at the second radial flange 114. In certain implementations, a second actuator 140 is operably coupled to the second locking member 130.

Figure 9:
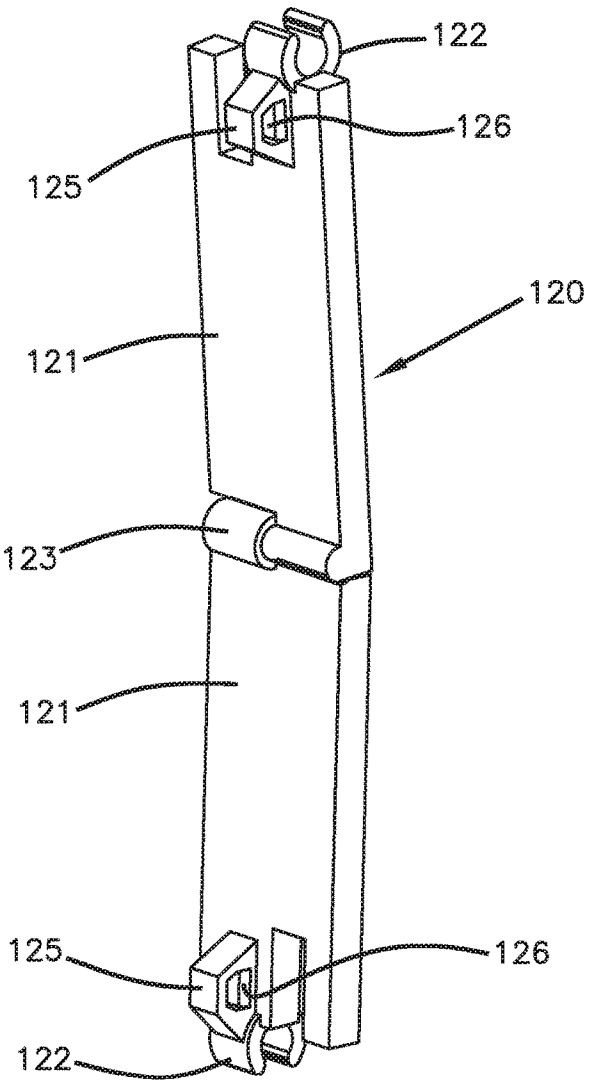
FIG. 9 is a perspective view of the stave of FIG. 8.
Figure 8:
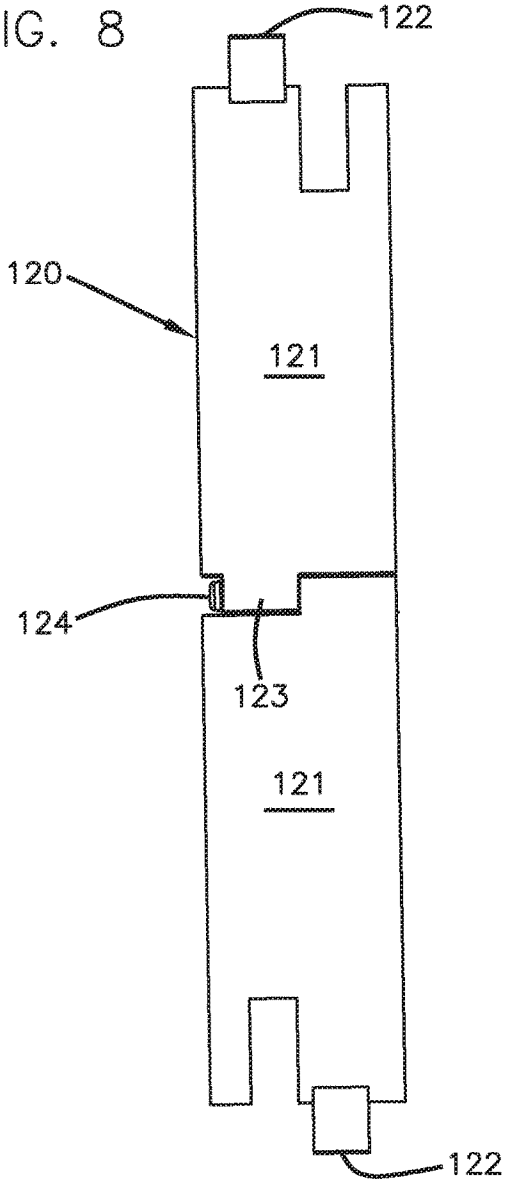
FIG. 8 is an elevational view of an example stave suitable for use in forming the drum of the spool of FIG. 1.
Figure 10:
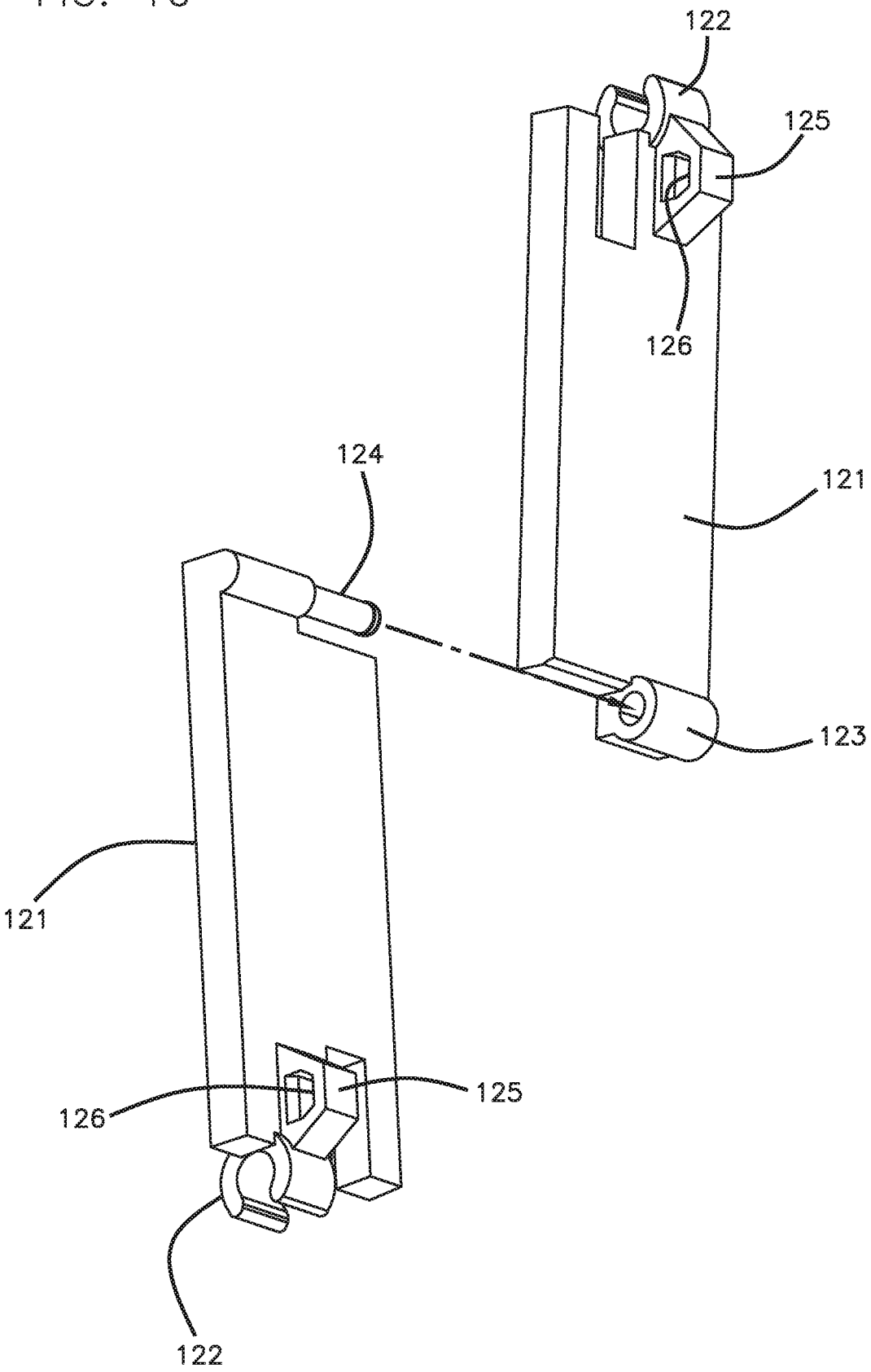
FIG. 10 shows the stave of FIG. 9 separated into two stave members.

FIGS. 8-10 show an example stave 120 suitable for use with the spool 100. The stave 120 extends along a length between a first end and a second end. Mounting members 122 are disposed at the first and second ends. The stave 120 is transitionable along its length. In some examples, the stave 120 is bendable or otherwise deformable along its length. In other examples, the stave 120 includes two stave members 121*a*, 121*b* coupled together to pivot about a pivot axis P. In certain examples, the pivot axis P extends generally perpendicular to the length of the stave 120. In certain examples, the pivot axis P is disposed at a generally central location along the length of the stave 120.

As shown in FIG. 10, each stave member 121*a*, 121*b* includes one of the mounting members 122. Each of the stave members 121*a*, 121*b* also forms part of the hinge at an opposite side of the stave member 121*a*, 121*b* from the respective mounting member 122. In the example shown, a first stave member 121*a* includes a pin holder 123 defining a hole and a second stave member 121*b* includes a hinge pin 124 that fits in the hole. Accordingly, the mounting member 122 of the first stave member 121*a* can pivot relative to the mounting member 122 of the second stave member 121*b*.

In certain implementations, at least one of the stave members 121*a*, 121*b* includes a retention member 125. In certain examples, the retention member defines a hole or recess 126. In certain examples, the retention member 125 is disposed at an interior surface of the drum 110. In certain examples, the retention member 125 is disposed opposite the pin holder 123 or hinge pin 124. In certain examples, the retention member 125 is disposed adjacent the mounting member 122.

Figure 11:
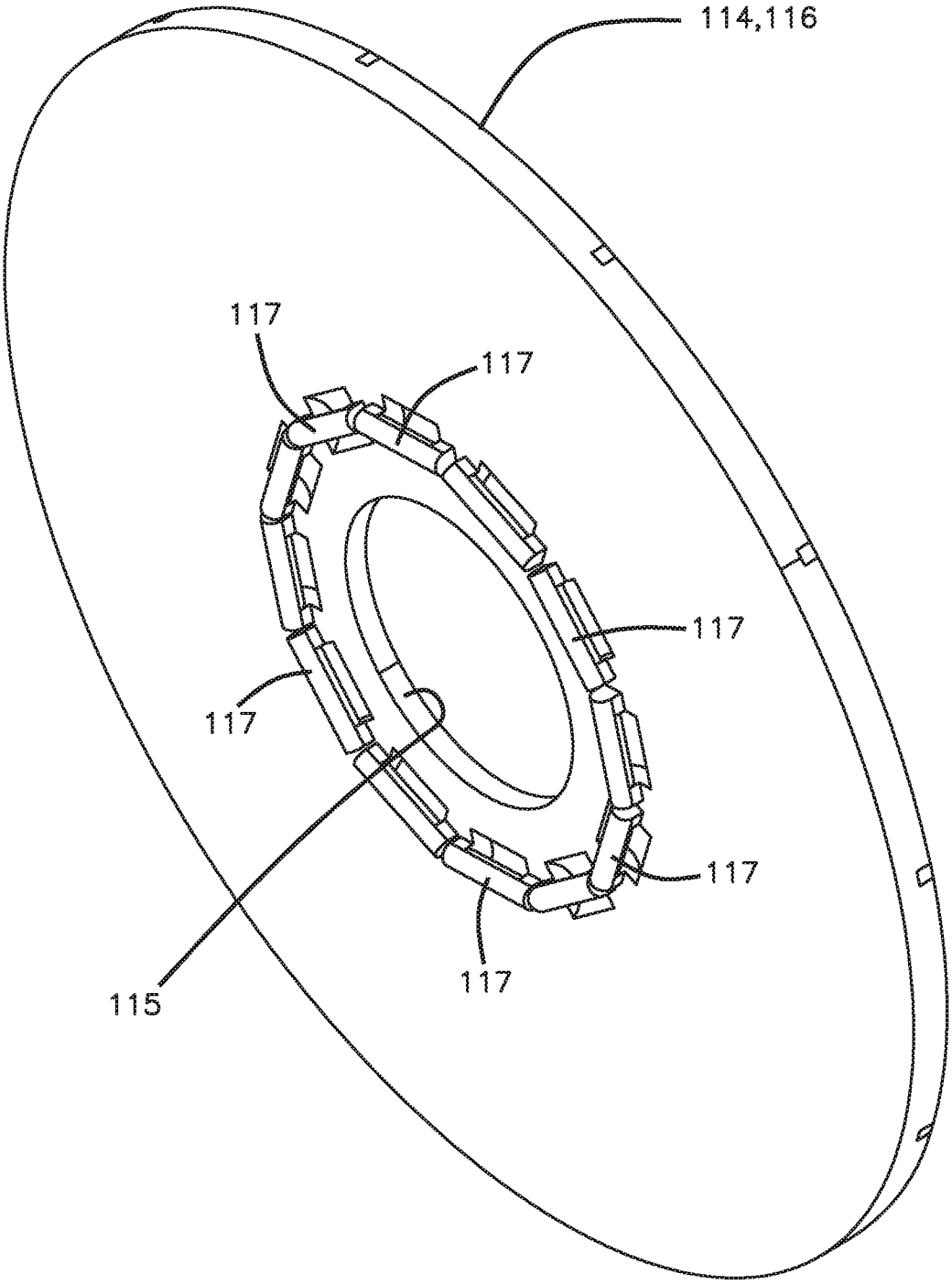
FIG. 11 is a perspective view of an example flange suitable for use with the spool of FIG. 1.
Figure 12:
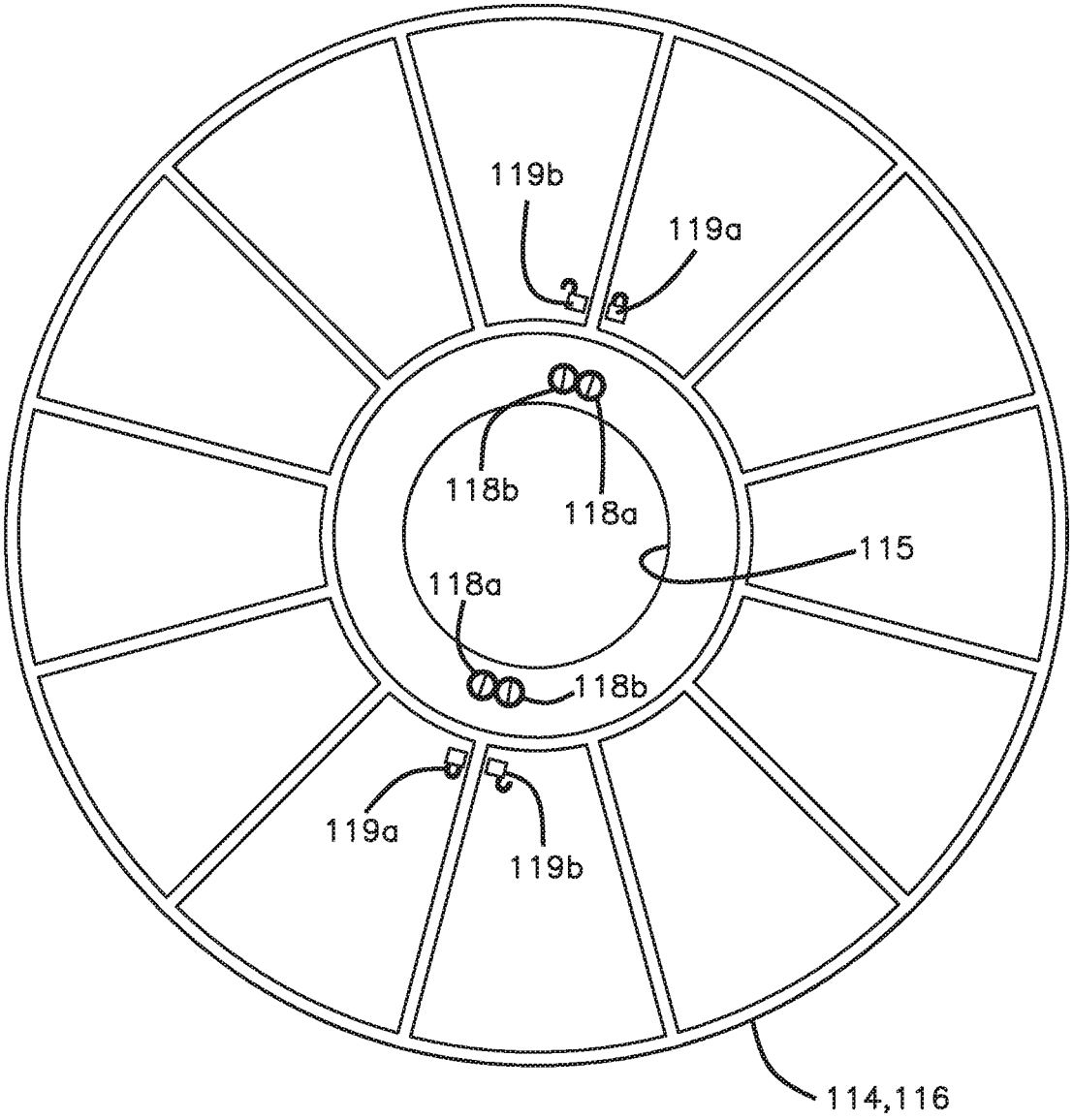
FIG. 12 is a plan view of the flange of FIG. 11.

FIGS. 11 and 12 illustrate an example radial flange 114, 116 suitable for use with the spool 100. The flange 114, 116 has a first major surface that faces the drum and a second major surface that faces away from the drum. The flange 114, 116 defines a through hole 115 extending between the first and second major surfaces. The staves 122 mount to the first surfaces of the flanges 114, 116.

In some implementations, the flange 114, 116 includes pin-shaped mounting members 117 at the first major surface. One of the mounting members 122 of each stave 120 snap-fits over a respective one of the mounting members 117 of the flange 114, 116. In other implementations, the mounting member 122 of the stave 120 is pin-shaped and the mounting member 117 of the flange 114, 116 includes snap-fit arms. In still other implementations, the mounting members 122, 117 of the stave 120 and flange 114, 116 otherwise fit together.

In certain implementations, the flange 114, 116 cooperates with the actuator 140 to guide the actuator 140 is toggling between the lock position and the release position. In certain examples, the flange 114, 116 includes protrusions (e.g., bumps) or depressions 118 at the second major surface. As will be discussed herein, a first of the protrusions or depressions 118*a* corresponds to the lock position of the actuator 140 and a second of the protrusions or depressions 118*b* corresponds to the release position of the actuator 140.

In certain implementations, the flange 114, 116 includes lock indicia 119*a* and release indicia 119*b*. As will be described herein, the lock/release indicia 119*a*, 119*b* cooperate with indicia on the actuator 140 to indicate to a user when the actuator 140 is disposed in the lock position and when the actuator 140 is disposed in the release position.

Figure 13:
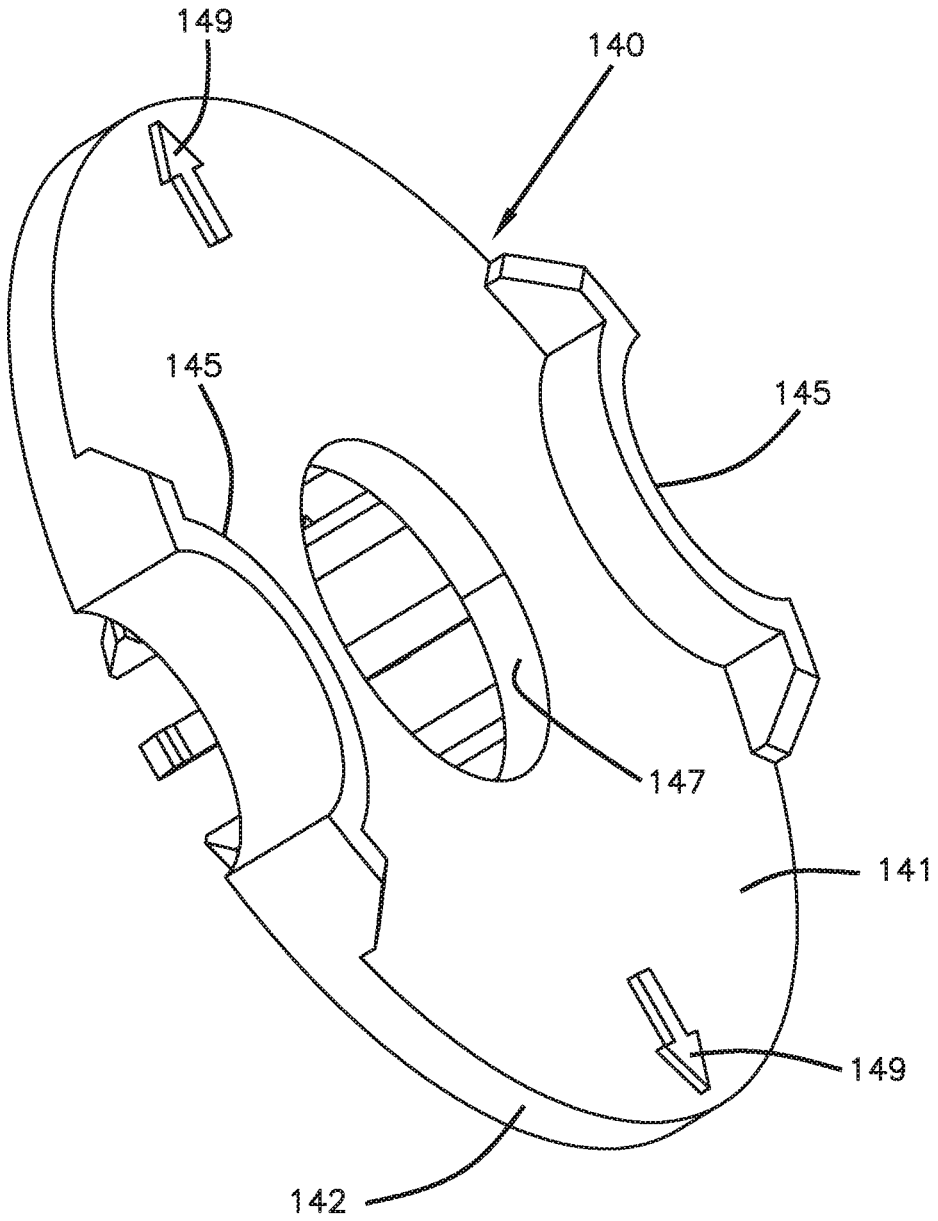
FIG. 13 is a first perspective view of an example actuation member suitable for use with the spool of FIG. 1.
Figure 14:
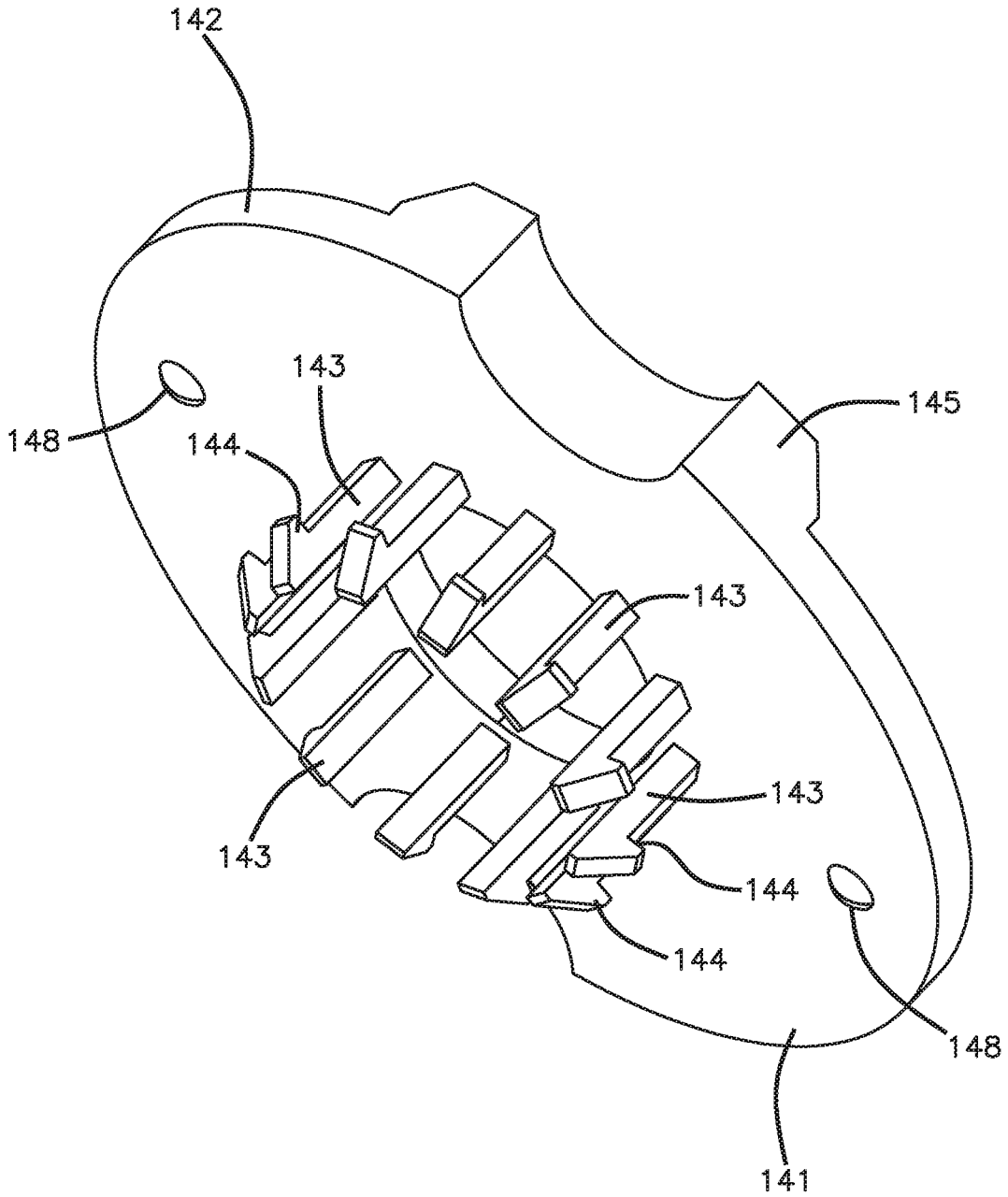
FIG. 14 is a second perspective view of the actuator member of FIG. 13.

FIGS. 13 and 14 illustrate an example actuator 140 suitable for use with the spool 100. The actuator 140 includes a body 141 that mounts to a corresponding one of the flanges 114, 116. The actuator body 141 has a peripheral edge 142 that fits within the through hole 115 defined in the corresponding flange 114, 116. The actuator body 141 also defines a through hole 147. In an example, the through hole 147 of the actuator 140 aligns with the through hole 115 of the flange 114, 116.

The actuator body 141 has a first side and an opposite second side. The first side faces towards the drum 110 and the second side faces away from the drum 110 when the actuator 140 is mounted to the flange 114, 116 spool 100. In certain implementations, the actuator body 141 is rotatably mounted to the flange 114, 116. In certain examples, the rotation of the actuator body 141 relative to the flange 114, 116 is limited between the lock position and the release position.

In certain examples, one or more grip members 145 are disposed at the second side of the actuator body 141. The grip member(s) 145 facilitate movement of the actuator 140 between the lock and release positions. In the example shown, two grip members 145 are disposed at opposite ends of the second side of the actuator body 141. In the example shown, the grip members 145 include raised walls bounding a notch into the peripheral edge 142 of the actuator 140. In other examples, the grip members 145 can include depressions in the second side of the actuator body 141, protrusions from the second side, handles, or other such structure.

In certain implementations, the actuator 140 includes a bump or recess 148 that fits with the protrusion or depression 118 of the flange 114, 116. In the example shown, each bump or recess 148 of the actuator 140 corresponds with a first and second protrusion or depression 118*a*, 118*b* of the flange 114, 116. The bump or recess 148 engages the first protrusion or depression 118*a* when the actuator 140 is in the lock position. The bump or recess 148 engages the second protrusion or depression 118*b* when the actuator 140 is in the release position. In the example shown, the actuator body 141 has two bumps or recesses 148 disposed at opposite ends of the second side. In other examples, the flange 114, 116 may have one protrusion or depression and the actuator 140 can have two bumps or recesses 148.

In certain implementations, indicia 149 is provided at the first side of the actuator body 141 to align with the lock and release indicia 119*a*, 119*b* on the flange 114, 116 to designate when the actuator 140 is in the lock position and when the actuator 140 is in the release position. The indicia 149 on the actuator 140 aligns with the lock indicia 119*a* on the flange 114, 116 when the bump or recess 148 of the actuator 140 engages the protrusion or depression 118*a* of the flange 114, 116. The indicia 149 on the actuator 140 aligns with the release indicia 119*b* on the flange 114, 116 when the bump or recess 148 of the actuator 140 engages the protrusion or depression 118*b* of the flange 114, 116.

In certain implementations, the actuator 140 is configured to entrain the locking member 130 when moved between the lock and release positions as will be described in more detail herein. In certain examples, the actuator 140 includes entrainment members 143 that extend from the first side of the actuator body 141 towards the drum 110. In some examples, the entrainment members 143 are teeth (e.g., gear teeth). In other examples, the entrainment members include latching hooks 144.

Figure 15:
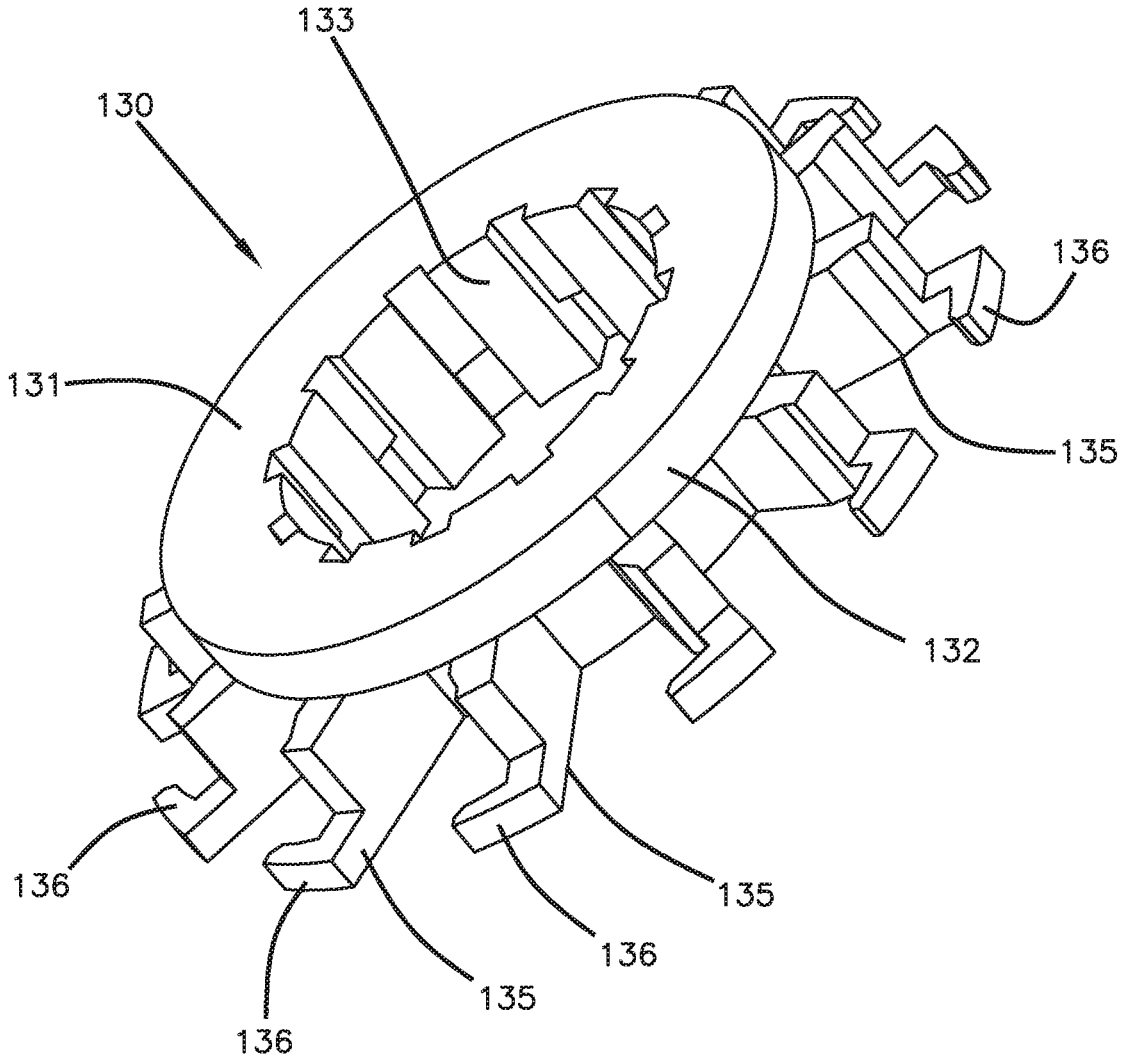
FIG. 15 is a first perspective view of an example locking member suitable for use with the spool of FIG. 1.
Figure 16:
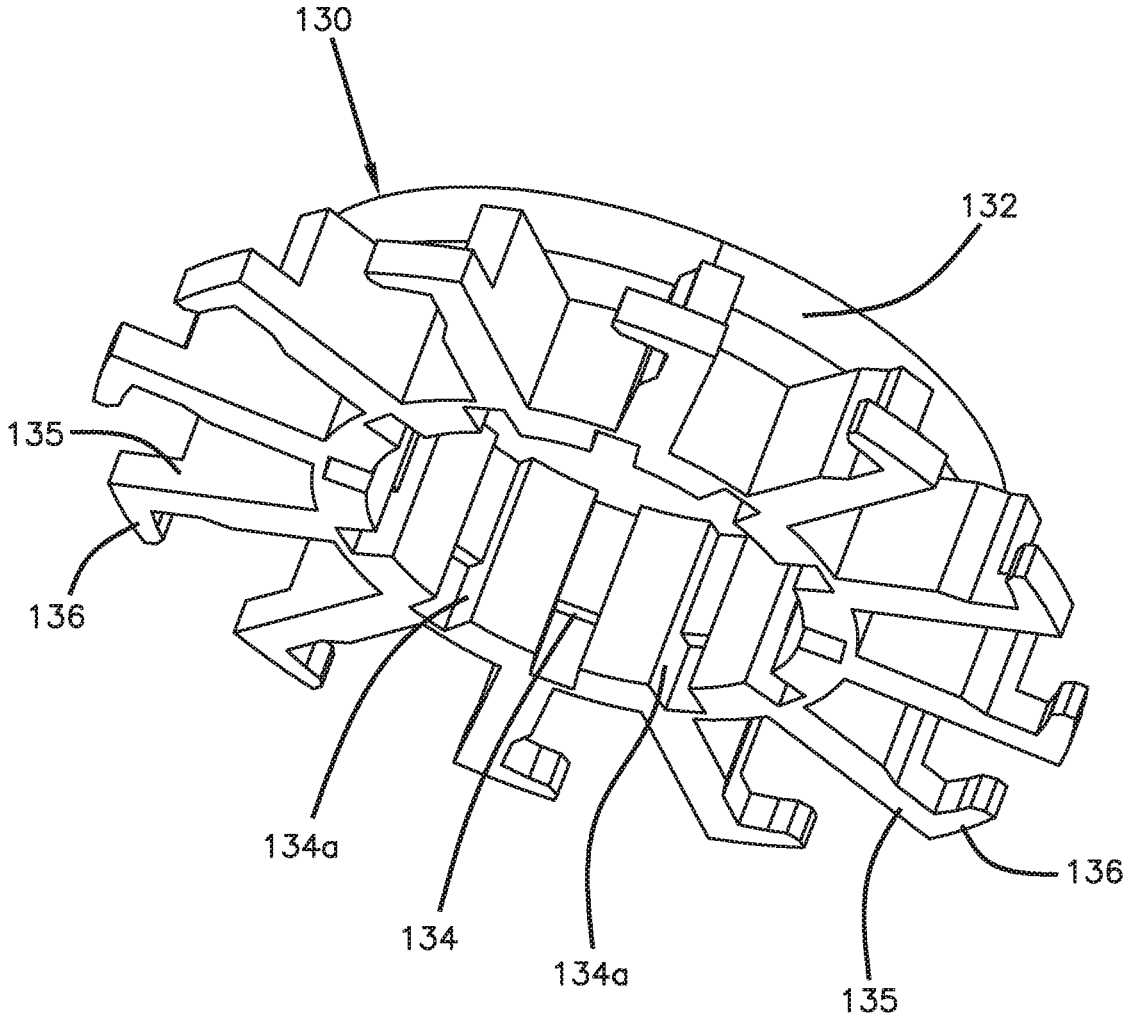
FIG. 16 is a second perspective view of the locking member of FIG. 15.

FIGS. 15 and 16 illustrate an example locking member 130 suitable for use with the spool 100. The locking member 130 engages with the drum 110 to inhibit a transition between the operable and stowed states of the spool 100. In certain examples, the locking member 130 engages the drum 110 to inhibit deformation of the drum 110. In certain examples, the locking member 130 engages the drum 110 to inhibit radial movement of the drum 110. In certain examples, the locking member 130 engages the drum 110 to inhibit movement or deformation between the drum 110 and the flanges 114, 116.

In certain implementations, the locking member 130 includes locking arms 135 that engage respective ones of the staves 120 of the drum 110. In certain examples, each locking arm 135 may have a lock finger 136 that engages a retention member 125 of the respective stave 120. For example, the lock finger 136 may slide into an opening defined by the retention member 125.

In certain examples, the locking arms 135 engage and release the staves 120 through rotation of the locking member 130. For example, the locking member 130 rotates with the actuator member 140 or a respective one of the actuator members 140 between the lock and release positions. The locking arms 135 engage the retention members 125 when the locking member 130 is disposed in the lock position. The locking arms 135 release the retention members 125 when the locking member 130 is disposed in the release position.

The locking member 130 defines a through hole 133 extending along a height between a first side facing the drum 110 and a second side facing away from the drum 110. In certain implementations, the locking member 130 includes a body 131 having a peripheral edge 132 sized to fit within the through hole 115 of the flange 114, 116. In certain examples, the locking arms 135 are disposed within the drum 110 when the body 131 is disposed within the through hole 115 of the flange 114, 116.

In certain implementations, the locking member 130 is configured to connect to the actuator 140 so that movement of the actuator 140 entrains movement of the locking member 130. In various examples, the locking member 130 and the actuator 140 latch together, fasten together, snap-fit together, friction-fit together, thread together, or otherwise couple together to move unitarily. In other examples, the locking member 130 and the actuator 140 can be an integral piece (e.g., monolithically formed).

In certain examples, the locking member 130 defines catch surfaces 134 within the through hole 133. In the example shown, the catch surfaces 134 define recessed shoulders facing towards the drum 110 when the actuator 140 is mounted to the spool 100. The entrainment members 143 of the corresponding actuator 140 engage the catch surfaces 134 to hold the actuator 140 to the locking member 130. In certain examples, latching hooks 144 of the actuator 140 snap-fit over the catch surfaces 134 when the spool 100 is assembled. The latching hooks 144 cooperate with the catch surfaces 134 to inhibit removal of the actuator 140 from the locking member 130, and hence the spool 100, along the rotation axis R.

Recessing the shoulders 134 radially into an inner peripheral wall of the through hole 133 causes the entrainment members 143 to press against the inner peripheral wall 134*a* when the actuator 140 is rotated. Accordingly, movement of the actuator 140 between the lock and release positions causes movement of the locking member 130 between the lock and release positions.

Figures 17, 18:
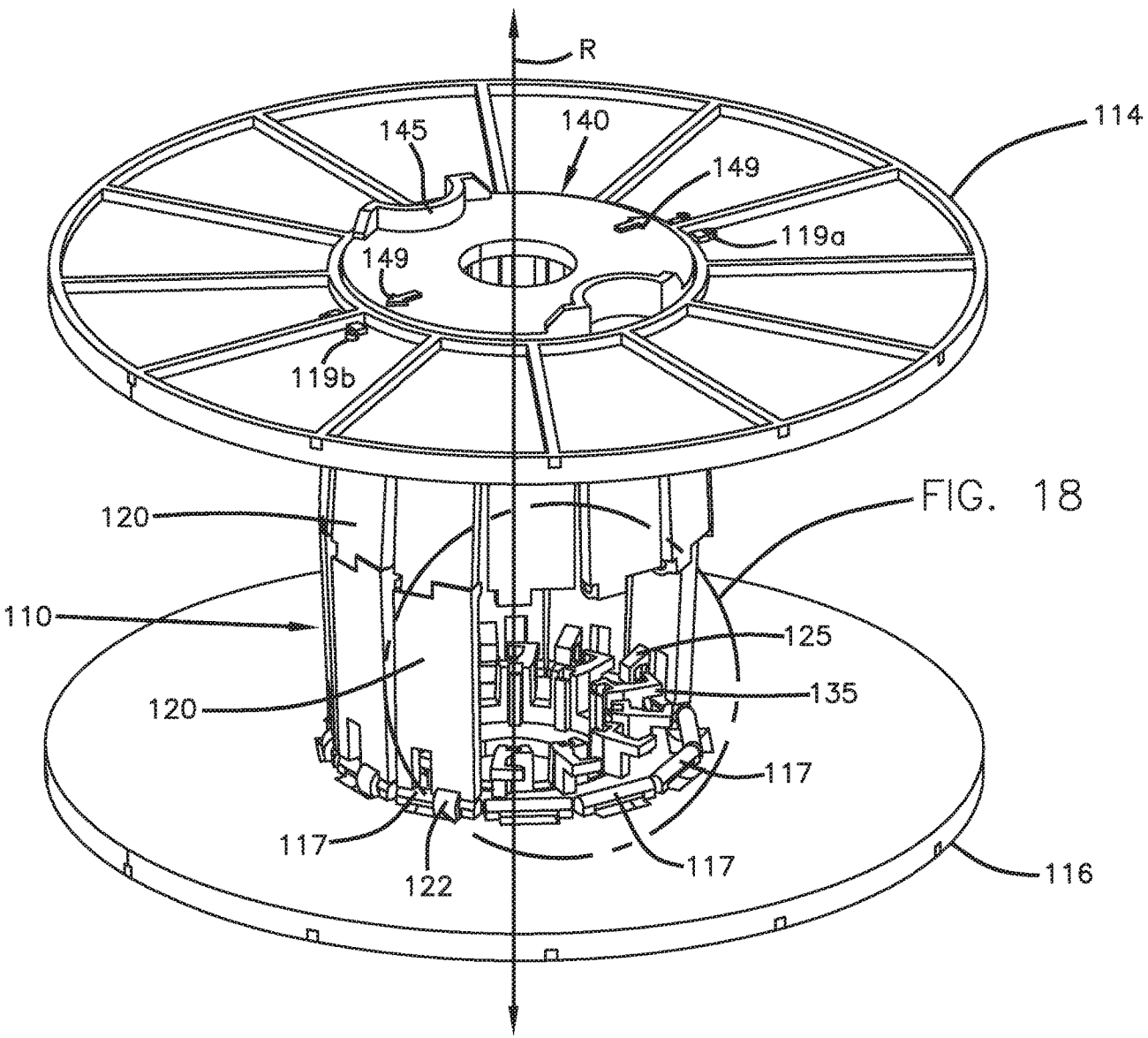
FIG. 17 is a perspective view of the spool of FIG. 1 with the locking arrangement disposed in the release position with a few stave members removed so that an interior of the drum is visible.
FIG. 18 is an enlarged view of a portion of FIG. 17.
Figure 18:
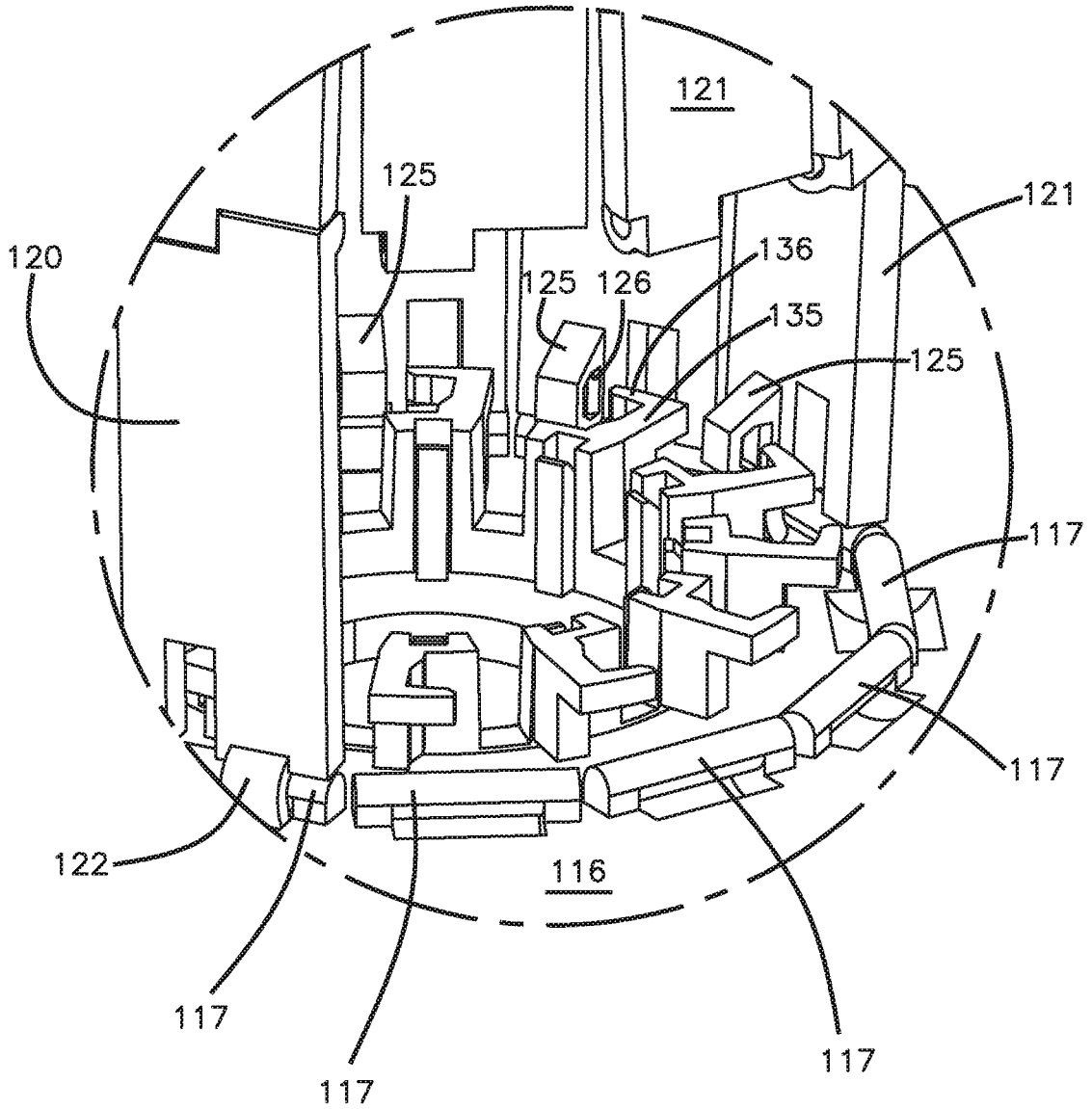
Figure 19:
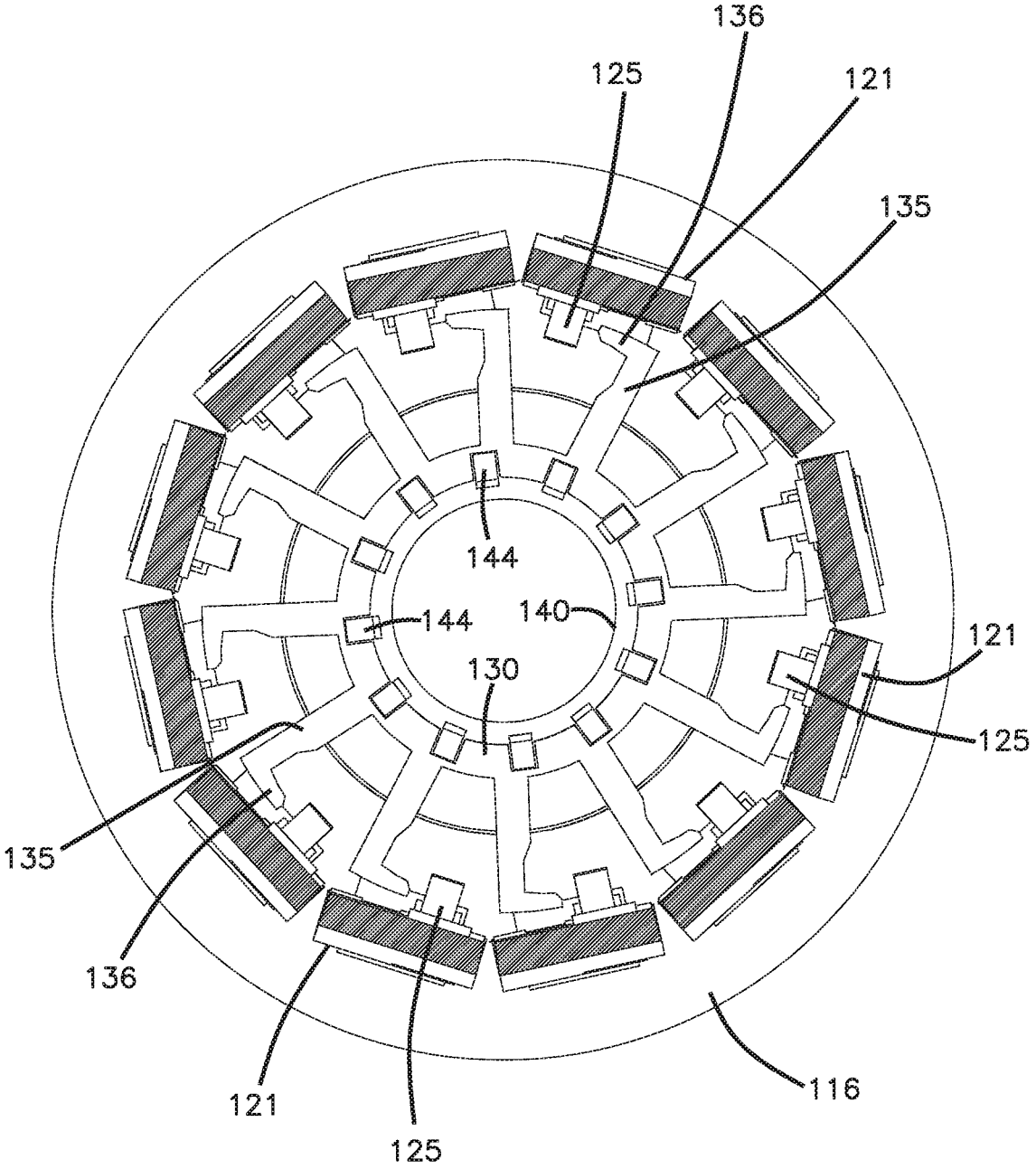
FIG. 19 is a transverse cross-sectional view of the spool of FIG. 3 taken along the 19-19 line.
Figure 20:
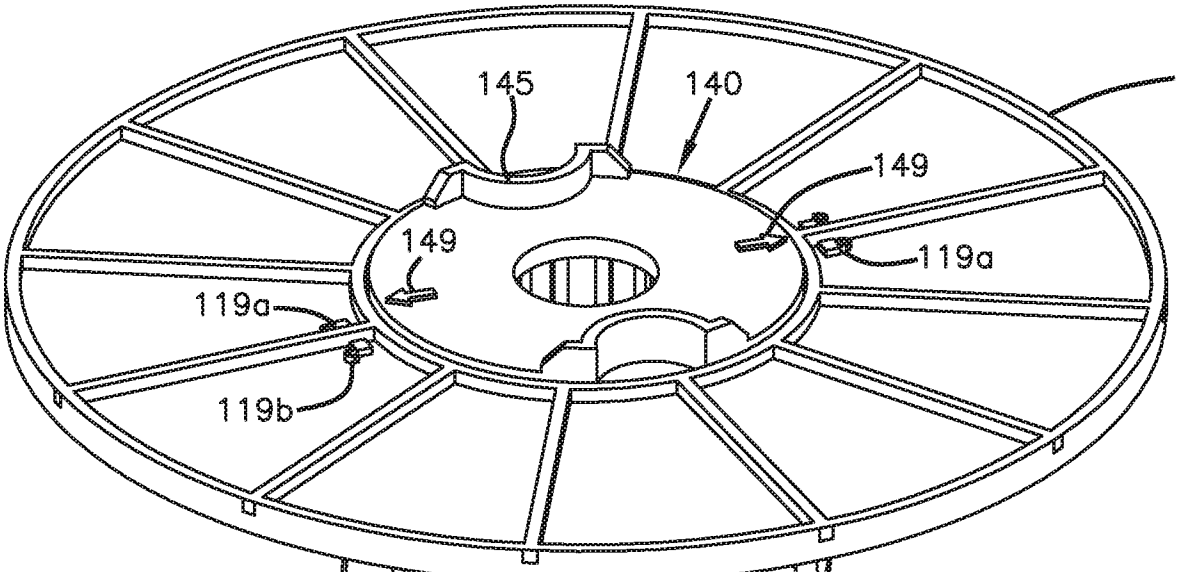
FIG. 20 is a perspective view of the spool of FIG. 1 with the locking arrangement disposed in the lock position with a few stave members removed so that an interior of the drum is visible.
Figure 21:
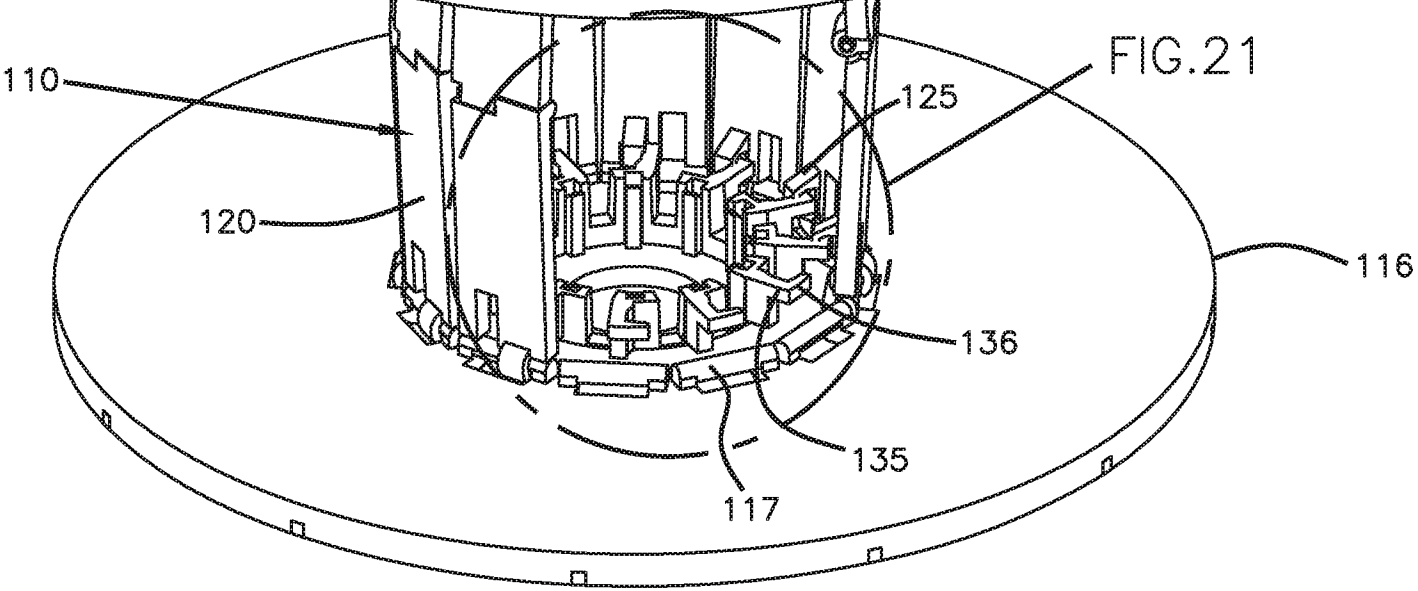
FIG. 21 is an enlarged view of a portion of FIG. 20.
Figure 21:
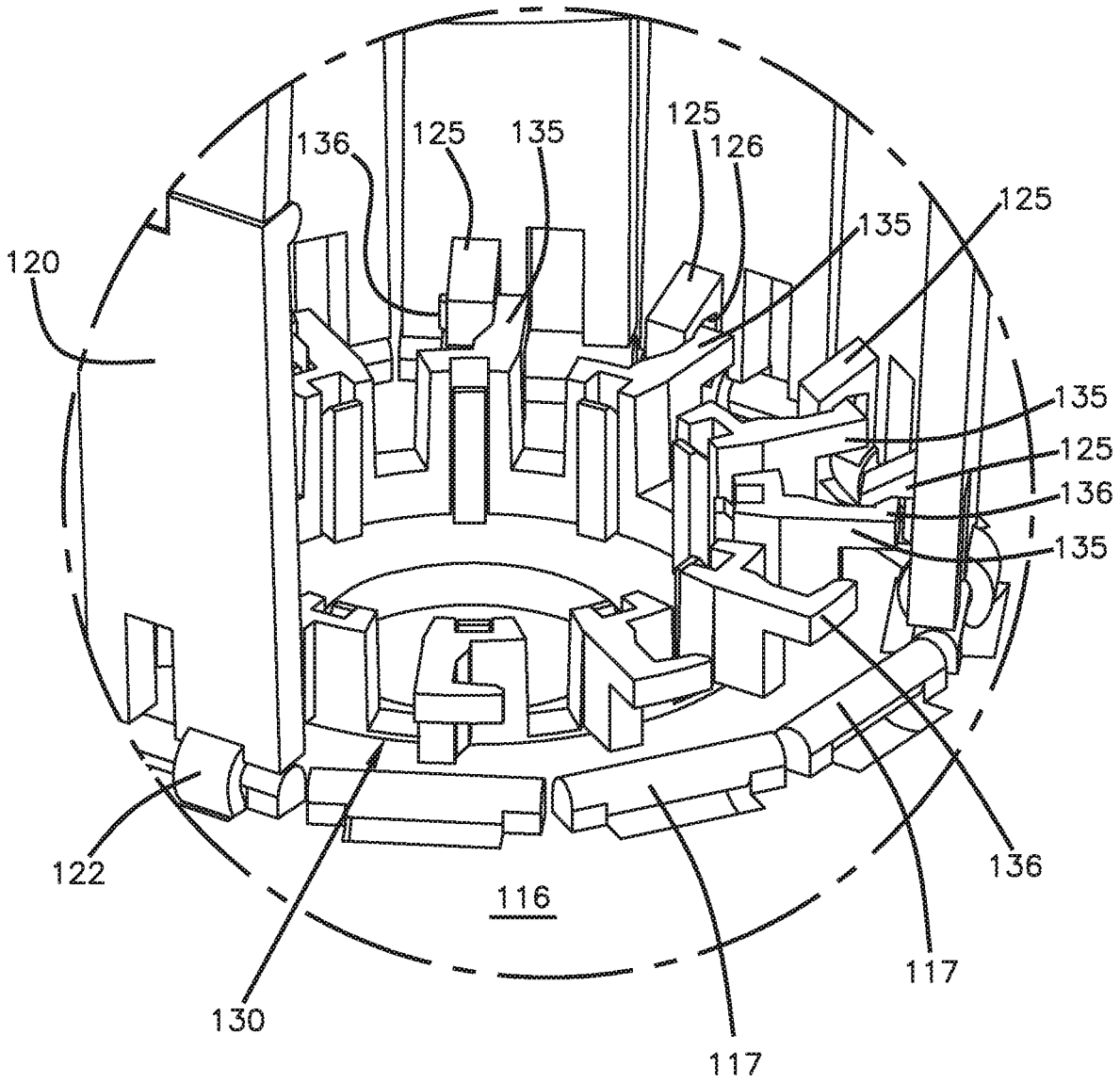

FIGS. 17-21 illustrate the operation of the locking arrangement of the spool 100. FIGS. 17-19 show the locking arrangement in the released position so that the spool 100 can be transitioned between the operable and stowed states. FIGS. 20-21 show the locking arrangement in the locked position so that the spool 100 cannot be transitioned between the operable and stowed states.

As shown in FIGS. 17-19, the actuators 140 are rotationally positioned relative to the respective flanges 114, 116 so that the indicia 149 aligns with the unlock indicia 119*b*. The locking member(s) 130 is disposed in the release position. Accordingly, the locking arms 135 are unengaged with the retention members 125 of the drum 110. For example, lock fingers 136 of the locking arms 135 are circumferentially spaced from the retention members 125 (see FIG. 19). Accordingly, pressing the flanges 114, 116 towards each other will cause the staves 120 to deform, pivot, or otherwise move to enable the flanges 114, 116 to be brought closer together (e.g., see FIGS. 4-6). For example, the mounting members 122 of the staves 120 can freely pivot relative to the mounting members 117 of the flanges 114, 116. Further, the hinge pin 124 of the stave can pivot relative to the pin holder 123, thereby allowing an intermediate portion of each stave 120 to move radially outwardly as the opposite sides of each stave 120 move closer together.

In FIGS. 19 and 20, the actuators 140 are rotationally positioned relative to the flanges 114, 116 so that the indicia 149 aligns with the lock indicia 119*a*. The locking member(s) 130 is disposed in the lock position. Accordingly, the locking arms 135 are engaged with the retention members 125 of the drum 110. For example, lock fingers 136 of the locking arms 135 extend into the holes 126 defined in the retention members 125 (see FIG. 21). Accordingly, pressing the flanges 114, 116 towards each other will not cause the staves 120 to deform, pivot, or otherwise move to enable the flanges 114, 116 to be brought closer together. Rather, the engagement between the locking arms 135 and the retention members 125 will inhibit pivoting of the staves 120 relative to the mounting members 117 of the respective flange 114, 116.

Having described the preferred aspects and implementations of the present disclosure, modifications and equivalents of the disclosed concepts may readily occur to one skilled in the art. However, it is intended that such modifications and equivalents be included within the scope of the claims which are appended hereto.

What is claimed is:

1. A spool assembly comprising:

a drum extending along a rotation axis between a first end and a second end;

a first flange extending radially outwardly from the first end of the drum;

a second flange extending radially outwardly from the second end of the drum;

the drum being repeatedly configurable between a use configuration and a stowed configuration, the second end being spaced from the first end by a first distance when the drum is arranged in the use configuration, the second end being spaced from the first end by a second distance when the drum is arranged in the stowed configuration, the second distance being shorter than the first distance; and a locking arrangement that releasably locks the drum in the use position, the locking arrangement having an actuator that rotates relative to the first flange.

2. The spool assembly of claim 1, wherein the drum defines an at least substantially continuous winding surface when the drum is arranged in the use configuration; and wherein the drum does not define a winding surface when the drum is arranged in the stowed configuration.

3. The spool assembly of claim 2, wherein the winding surface is sized to provide bend radius limit protection to optical fibers wound around the winding surface.

4. The spool assembly of claim 1, wherein the locking arrangement releasably locks the drum in the stowed position.

5. The spool assembly of claim 1, wherein the locking arrangement has an actuator that rotates relative to the drum.

6. The spool assembly of claim 1, wherein the drum includes a plurality of foldable staves.

7. The spool assembly of claim 6, wherein the locking arrangement inhibits folding of the staves when actuated.

8. A spool assembly comprising:

a drum extending along a rotation axis between a first end and a second end;

a first flange extending radially outwardly from the first end of the drum;

a second flange extending radially outwardly from the second end of the drum;

the drum being repeatedly configurable between a use configuration and a stowed configuration, the second end being spaced from the first end by a first distance when the drum is arranged in the use configuration, the second end being spaced from the first end by a second distance when the drum is arranged in the stowed configuration, the second distance being shorter than the first distance; and a locking arrangement that releasably locks the drum in the use position, the locking arrangement being mounted at the first flange and at the second flange, the locking arrangement being movable relative to the first and second flanges.

9. The spool assembly of claim 8, wherein the drum defines an at least substantially continuous winding surface when the drum is arranged in the use configuration; and wherein the drum does not define a winding surface when the drum is arranged in the stowed configuration.

10. The spool assembly of claim 8, wherein the locking arrangement releasably locks the drum in the stowed position.

11. The spool assembly of claim 8, wherein the locking arrangement has an actuator that rotates relative to the drum.

12. The spool assembly of claim 8, wherein the drum includes a plurality of foldable staves, wherein the locking arrangement inhibits folding of the staves when actuated.

13. A spool assembly comprising:

a spool extending along a height between a first axial end and a second axial end, the spool including a plurality of staves that cooperate to provide an at least substantially continuous winding surface when the spool is in a use configuration, each stave defining a retention member; and a locking arrangement disposed on the spool, the locking arrangement holding the spool in the use configuration in which the spool defines the at least substantially continuous winding surface, the locking arrangement being releasable to enable the spool to transition to a stowed configuration in which the spool does not define the at least substantially continuous winding surface, the locking arrangement including a first ring having a plurality of locking members disposed about a circumference of the first ring; each locking member being sized to fit within the retention member of one of the staves.

14. The spool assembly of claim 13, wherein the staves are spaced from each other along a majority of a length of each stave when the spool is in the stowed configuration.

15. The spool assembly of claim 13, wherein the first ring is rotatable relative to the first axial end of the spool between a locked position and a released position, wherein the locking members of the first ring are engaged with the retention members of the staves when the first ring is disposed in the locked position, and wherein the locking members are spaced from the retention members when the first ring is disposed in the released position.

16. The spool assembly of claim 13, wherein the retention member of each stave is a first retention member, wherein each stave also includes a second retention member at an opposite end of the stave from the first retention member, and wherein the locking arrangement also includes a second ring having a respective plurality of locking members disposed about a circumference of the second ring, the locking members of the second ring being sized to fit within the second retention members of the staves.

17. The spool assembly of claim 13, wherein the spool includes a first radial flange at the first axial end and a second radial flange at the second axial end.

18. The spool assembly of claim 17, wherein the locking arrangement includes an actuator disposed at the first radial flange, the actuator being movable relative to the first radial flange.

19. The spool assembly of claim 18, wherein the actuator is a first actuator; and wherein the locking arrangement also includes a second actuator disposed at the second radial flange, the second actuator being movable relative to the second radial flange.

20. The spool assembly of claim 13, wherein the spool assembly is symmetrical about a plane intersecting the height of the spool.

* * * * *